US006033590A

United States Patent [19]

Komforth et al.

[11] Patent Number: 6,033,590

[45] **Date of Patent: *Mar. 7, 2000**

[54] COMPOSITIONS FOR THE PREPARATION OF LEATHER

[75] Inventors: Reiner Komforth, Ratingen, Germany; Alain Lauton, Saint-Louis, France

[73] Assignees: Ciba Specialty Chemicals Corp., Tarrytown, N.Y.; TFL Ledertechnik GmbH & Co. KG, Weil am Rhein, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/994,879

[22] Filed: Dec. 19, 1997

[30] Foreign Application Priority Data

Dec. 20, 1996 [DE] Germany ..... 196 53 549
Oct. 21, 1997 [DE] Germany ..... 197 46 445

[51] Int. Cl.[7] ..... C14C 3/00; C14C 9/02

[52] U.S. Cl. ..... 252/8.57; 8/94.1 R; 8/94.18; 8/94.19 R; 8/94.2; 8/94.21; 8/94.22; 8/94.23

[58] Field of Search ..... 252/8.57; 8/94.19 R, 8/94.18, 94.2, 94.21, 94.22, 94.23, 94.1 R

[56] References Cited

U.S. PATENT DOCUMENTS

| | | | |
|---|---|---|---|
| 4,470,825 | 9/1984 | Landbeck et al. | 252/8.57 |
| 4,729,767 | 3/1988 | Friese et al. | 252/8.57 |
| 4,744,794 | 5/1988 | Friese et al. | 8/94.23 |
| 5,264,000 | 11/1993 | Lauton et al. | 252/8.57 |
| 5,527,360 | 6/1996 | Birkhofer et al. | 252/8.57 |
| 5,733,340 | 3/1998 | Lauton | 252/8.57 |

FOREIGN PATENT DOCUMENTS

| | | | |
|---|---|---|---|
| 2056345 | 5/1972 | Germany . | |
| 3419405 | 11/1985 | Germany . | |
| 4121865 | 1/1993 | Germany . | |
| 344996 | 8/1972 | U.S.S.R. | 252/8.57 |
| 1343918 | 1/1974 | United Kingdom . | |

OTHER PUBLICATIONS

Hackh's Chemical Dictionary, Third Edition (1994), p. 378. [No Month].

Derwent Abstract, 85–315316, abstract of Soviet Union Patent Specification No. (158586 (May 1985).

Derwent Abstract, 93–018886, abstract of German Patent Specification No. 4121865 (Jan. 1993).

*Primary Examiner*—Anthony Green
*Attorney, Agent, or Firm*—Kevin T. Mansfield

[57] ABSTRACT

Compositions for the simultaneous retanning and fatliquoring of leather are described which may include further leather treatment agents as well.

22 Claims, No Drawings

COMPOSITIONS FOR THE PREPARATION OF LEATHER

The present invention relates to novel compositions for the simultaneous retanning and fatliquoring of pretanned leather or pelts, to processes for preparing these compositions, and to the use of these compositions for the preparation of leather or pelts.

In the preparation of leather the pretanned hides are usually neutralized, then retanned, fatliquored and, if desired, subsequently dyed and treated further. The operations beginning with the neutralization are frequently conducted in separate baths or in succession in one bath, but may also take place simultaneously in one bath. The products employed in these operations are usually used individually in solid or liquid form, since it is difficult to prepare homogeneous mixtures. The fatliquoring agents, in fact, are almost exclusively liquid or at least wax-like and cannot be processed by existing methods with the solid components, for example the neutralizing agents and retanning agents, to give mixtures in which homogeneous distribution of the components and satisfactory stability on storage are ensured for a sufficiently long period and at varying temperatures.

Novel preparations have now been found which allow an important simplification to the wet dressing of leather, since with only one composition it is possible simultaneously to carry out retanning and fatliquoring and also, if appropriate, further treatments as well. The reason for this is that these compositions comprise retanning agent and fatliquoring agent in a form such that on addition to at least 8 times the amount of water at from 10 to 60° C. they give homogeneous mixtures.

Surprisingly, when the novel compositions are used there is a synergistic effect. It is in fact possible to make a significant reduction in the amount of retanning and fatliquoring agents employed relative to a procedure in which these chemicals are employed individually, despite the fact that the conventional retanning and fatliquoring agents are used. Fat emulsification, in particular, is improved when the novel compositions are used, and smaller amounts of fatliquoring agents can be used. The novel compositions have outstanding stability on storage and are frost-proof in the case of solid compositions.

When the novel compositions are used it is possible, moreover, to reduce markedly the transportation and storage requirements as compared with the use of specific compositions for each individual treatment step, and handling is greatly simplified. Moreover, the compositions bring a saving in water and time of up to 60% and facilitate the reproducibility of the quality of the resulting leather. Moreover, the use of the novel compositions accelerates and/or enhances the penetration and distribution of the chemicals into the leather. This results, for example, in better dye penetration of the leather. Also influenced in an advantageous manner are other important properties of leather, such as water resistance, fogging behaviour, adhesive strength of dressing films, stretch and strength properties, and the mass per unit area.

The present invention accordingly provides compositions for the preparation of leather or pelts, which compositions comprise a) a retanning agent and b) a fatliquoring agent and also, if desired, c) further additives and are present in a form such that on addition to at least 8 times the amount of water at from 10 to 60° C. they give homogeneous mixtures.

The novel compositions are preferably in a form such that they can be distributed homogeneously by customary incorporation by stirring into water which is at from 10 to 60° C., to form suspensions or dispersions which are stable for the duration of the leather treatment. Customary incorporation by stirring here means simple stirring using stirrers which are used in the leather industry.

The novel compositions are preferably in a form such that on addition to water they form micelles containing retanning agent and fatliquoring agent.

In the dispersions or suspensions, preferably 50% of the particles have a size below 15 $\mu$m. Particular preference is given to those novel compositions which on addition to water form micelles in which 90% of the particles have a size of below 40 $\mu$m.

The novel compositions are suitable for the treatment of the so-called semi-finished goods prepared for wet dressing, i.e. pretanned leather, e.g. wet blue and wet white.

The retanning agents can be of natural or synthetic origin. Suitable examples are the nowadays commonly used compounds such as vegetable tanning agents, aromatic syntans, resin tanning agents, reactive tanning agents, mineral tanning agents and polymeric tanning agents.

Examples of suitable vegetable tanning agents are tanning agents obtained from mimosa, quebracho, oak, chestnut or pine bark. Particularly suitable vegetable tanning agents are those comprising pyrogallol or pyrocatechol.

Examples of suitable aromatic syntans are those compounds which are obtainable by condensation of sulfonated aromatic compounds—alone or together with further, usually unsulfonated aromatic compounds—with formaldehyde and/or urea.

Examples of aromatic compounds suitable for this purpose are naphthalene, biphenyl, terphenyl, phenols, cresols, 4,4'-dihydroxydiphenyl sulfone, β-naphthol, dihydroxybenzenes, resorcinol, 2,2-bis(hydroxyphenyl) propane and diaryl ethers, such as diphenyl ethers and ditolyl ethers, which may have been sulfonated in a manner known per se.

Particularly suitable anionic aromatic syntans are the following compounds:

(I) condensation products of sulfonated phenol or cresol and formaldehyde, (II) condensation products of naphthalene sulfonic acid and formaldehyde, (III) formaldehyde condensation products of 4,4'-dihydroxydiphenyl sulfones with arylsulfonic acids or (hydroxy)arylsulfonic acids, (IV) formaldehyde condensation products of sulfo-containing aromatic hydroxy compounds with aralkyl halides.

(V) urea-formaldehyde condensation products of phenols and phenolsulfonic acids.

(VI) reaction products of phenol and a sulfonating agent, where the molar ratio (phenol):($SO_3$) is (1):(1.1–2.2).

(VII) condensation products of sulfonated diaryl ethers and formaldehyde, (VIII) condensation products of sulfonated bi- or terphenyls and formaldehyde, (IX) condensation products of 4,4'-dihydroxydiphenyl sulfone and sulfonated 4,4'-dihydroxydiphenyl sulfone with formaldehyde, (X) formaldehyde condensation products of diaryl ether sulfonic acid and 4,4'-dihydroxydiphenyl sulfone, and (XI) formaldehyde condensation products of phenol with arylsulfonic acids or hydroxyarylsulfonic acids.

These condensation products are in the form of the free acids, preferably in the form of the sulfonic acids, or as salts, especially ammonium, lithium, potassium or, in particular, sodium salts.

These condensation products are known, for example from Ullmanns Enzyklopädie der technischen Chemie Vol. 16, (4), 138 to 140 (1979), or can be prepared by the methods described in the references indicated therein.

Examples of suitable resin tanning agents are the cationic condensation products of nitrogen-containing organic compounds, such as urea, thiourea, dicyandiamide or melamine, with formaldehyde or other simple oxo compounds.

Other suitable resin tanning agents are the anionic compounds that are obtained when condensation products of nitrogen-containing organic compounds, for example urea, thiourea, dicyandiamide or melamine, are condensed with formaldehyde or other simple oxo compounds and with anionic compounds, for example phenols, alkali metal salts of aromatic sulfonic acids, sulfonamides, ligninsulfonates, sulfite or hydrogen sulfite.

Particularly preferred resin tanning agents are the condensation products of urea with formaldehyde, and dicyandiamide-based resin tanning agents.

Examples of suitable reactive tanning agents are mono-, di- and polyaldehydes, especially glutaraldehyde, polyfunctional isocyanates, alkyl sulfochlorides, relatively high molecular mass alkylsulfonates and also monomeric vinyl derivatives and acrylic derivatives and polymers thereof.

Suitable mineral retanning agents are the known chromium, aluminium, iron or zirconium salts, examples being chromium(III) chloride or sulfate, chrome alum, nonbasic or basic aluminium chloride or sulfate, iron(III) chloride or sulfate, zirconium oxychloride and zirconium sulfate.

Examples of the polymeric retanning agents are polyacrylates, copolymers comprising acrylates, polyurethanes or polybutadienes.

These retanning agents are known and to a large extent available commercially.

In the novel compositions, the tanning agents employed are preferably vegetable tanning agents, aromatic syntans or reactive tanning agents.

Suitable fatliquoring agents are the customary agents which are commonly used for the fatliquoring of leather, preferably a) fatliquoring agents based on animal fats, for example fish oil, neat's-foot oil, wool fat or lard oil, b) fatliquoring agents based on vegetable fats, for example castor oil, coconut oil or olive oil, c) synthetic fatliquoring agents, for example products of the chlorination and sulfochlorination of paraffinic hydrocarbons; synthetic fatty acid esters and ester oils, d) mineral oils and other petrochemical products.

These fatliquoring agents are preferably in a form modified by sulfating, sulfiting or formation of sulfonic acids, so that they are soluble or emulsifiable in water. It is also possible to employ a fatliquoring mixture part of which has emulsifying properties and so acts as an emulsifier for the remaining part. Examples of products suitable for this purpose are sulfated fatty alcohols.

These fatliquoring agents are preferably employed as aqueous solutions or emulsions.

The novel compositions for the preparation of leather may in each case include a single neutralizing agent, a retanning agent and a fatliquoring agent, or else may comprise mixtures of in each case two or more of these components. Indeed this is normally the case, since these compounds are rarely pure substances but instead comprise technical mixtures of numerous, more or less similar compounds.

In addition to retanning agents and fatliquoring agents the novel leather treatment compositions may comprise further additives, examples being neutralizing agents, carriers, colorants, impregnants, dressing agents and dressing auxilaries.

Suitable neutralizing agents are the known compounds with which it is possible gently to neutralize the strongly acidic, pretanned leathers. Neutralizing agents include those compounds which raise the pH of the strongly acidic, pretanned leathers, for example to 4.5, without being able to reach the neutral pH of 7. Examples of suitable neutralizing agents for the novel compositions are alkali metal salts of inorganic or organic weak acids; aromatic sulfonic acids, or aliphatic mono- or dicarboxylic acids. They preferably comprise sodium or potassium bicarbonate, formate or acetate, oxalic acid, malonic acid, adipic acid, or condensed sulfonated phenols. Particularly suitable are sodium bicarbonate, sodium formate, acetic acid, adipic acid or sulfonated diphenyl sulfones.

Examples of suitable carriers are sodium chloride, Glauber salt, sodium formate, protein powders, starch, kaolin, polysaccharides, glucose or gelatin.

Appropriate colorants are the commonly employed leather colorants, examples being natural colorants, and also synthetic colorants, for example anionic dyes, metal complex dyes, direct dyes, cationic dyes or sulfur dyes. The term colorants also includes pigments, i.e. colorants largely insoluble in water.

The impregnants are likewise known compositions which are used in the leather industry, for example agents for protecting against water, organic solvents or oils or against dirt, agents for improving the resistance to abrasion, scuffing of other mechanical damage, agents for improving the temperature stability or light fastness, and for reducing inflammability, or antistatics.

Examples of suitable dressing agents are bottoming agents, such as polyacrylates, butadiene copolymers or polyurethanes, or finishes, such as casein, nitrocellulose or polyurethane preparations.

Dressing auxiliaries which are suitable are the products which are likewise known and utilized in practice, examples being penetrators, primers and fillers, anti-tack agents, thickeners and stabilizers, softening agents, matting agents, handle agents and fixing agents.

The novel compositions for the preparation of leather preferably comprise a) 10–80% by weight of a retanning agent, b) 5–50% by weight of a fatliquoring agent, and c) 0–55% by weight of other additives.

While preference is given to compositions which are solid at a temperature below 40° C., it is also possible to employ the novel compositions in the form of solutions, dispersions or emulsions in an appropriate solvent, preferably in water.

Particularly suitable novel compositions for the preparation of leather comprise a) 10–60% by weight of a retanning agent, b) 10–45% by weight of a fatliquoring agent, c) 10–40% by weight of a neutralizing agent, and d) 0–40% by weight of further additives.

Among these, particular preference is given to those compositions which comprise a) 20–60% by weight of a retanning agent, b) 10–40% by weight of a fatliquoring agent, c) 10–25% by weight of a neutralizing agent d) 2–35% by weight of further additives.

The percentage is based in each case on the overall weight of the compositions for the treatment of leather.

The novel compositions are prepared in a manner known per se, for example by mixing a retanning agent, a fatliquoring agent and, if desired, further additives with one another in undiluted form. In this case the retanning agent and fatliquoring agent and any further additives present must be selected such that the resulting compositions on addition to at least 8 times the amount of water at from 10 to 60° C. give homogeneous mixtures.

It is preferred, however, to employ retanning agent, fatliquoring agent and any other additives as solutions or suspensions, or else dispersions, to mix them and then to dry the mixture.

In the case of the solutions, suspensions and dispersions the preferred solvent used is water, although organic solvents, for example mono- or polyhydric alcohols or hydrocarbons, are also suitable.

Mixing takes place, for example, at a temperature between 10 and 60° C., but preferably at room temperature, i.e. between about 15 and 25° C. After mixing it is necessary, preferably, for a homogeneous distribution of the constituents of the suspensions or dispersions to be present, which if required can be achieved by means of suitable measures such as, for example, the use of specific stirrers or ultrasonic treatment.

Drying takes place in conventional manner, but should normally be conducted under conditions in which the homogeneous distribution of the constituents of the mixtures is retained. If all of the components are readily soluble in water or readily emulsifiable or dispersible, the mode of drying is irrelevant.

With preference a method is used in which drying takes place very rapidly.

Drying is preferably carried out by spray drying at from about 80 to 140° C., in particular from 100 to 120° C.

It is also possible to spray the solution, suspension or dispersion onto an initial charge of carrier material, for example sodium chloride, Glauber salt, sodium formate, protein powder or starch, and, simultaneously or subsequently, to carry out drying.

In accordance with these processes the novel compositions are obtained in the form of powders or granules which can be employed in this form to prepare aqueous liquors for leather preparations. The compositions are non-dusting, are easy to distribute homogeneously in water, and remain free-flowing even on prolonged storage and even at temperatures up to about 40° C. If no carrier material is used, or else if a non-saltlike compound is used as carrier material, the novel compositions can be produced in salt-free or low-salt form, which is often of advantage in connection with further processing, for example in the case of simultaneous or subsequent dyeing, and relieves strain on the environment.

The novel compositions are suitable for the preparation of different types of leather, for example for full-grain, lightly or heavily retanned leathers or velour leathers of goat, sheep, cattle or pig. Using these compositions it is possible to prepare leathers for all applications, for example shoe, furniture, car, clothing and bag maker's leathers. The novel compositions are likewise suitable for the retanning and fatliquoring of pelts, with the hairs remaining largely unaffected.

The preparation of the leathers can be carried out in all machines customary for the wet dressing, for example in a vat, Dosamat, tanning machine or mixer.

Preparation takes place, for example, by charging pretanned leather, for example wet blue or wet white, at 10–50° C. in 50–300% of water, based on the weight of the substrate, then adding 5–30% of the novel composition and leaving it to act for 30–180 minutes at the stated temperature, with circulation. Subsequently, if desired, 1–3% of formic acid in two portions is added over the course of 15 minutes and treatment is continued for 40–60 minutes. The liquor is then drained, the leather is washed for 5–10 minutes with 100–300% of water, the washing liquor is drained, and the leather is finished conventionally.

If use has been made of a novel composition which other than retanning agent and fatliquoring agent contains no other active substances, then the subsequent treatment steps, such as neutralization, dyeing and dressing, can be carried out conventionally.

The present invention therefore additionally provides a process for the preparation of leather or pelts, which comprises treating pretanned leathers or pelts in aqueous liquor with a composition which comprises a) a retanning agent and b) a fatliquoring agent and also, if desired, c) further additives and is in a form such that on addition to at least 8 times the amount of water at from 10 to 60° C. it gives a homogeneous mixture.

By the process according to the invention, leathers of equal or better quality are obtained than those in whose preparation the treatment has been carried out with retanning agent and fatliquoring agent in separate steps in each case.

The examples which follow illustrate the invention without restricting it to them. Parts and percentages are by weight. The temperatures are indicated in ° Celsius.

EXAMPLE 1

The following components are mixed at room temperature to form a homogeneous mixture:

12.5 parts of a neutralizing agent (about 35% aqueous solution of a mixture of aromatic sulfonic acids with aliphatic dicarboxylic acids), 12.5 parts of a penetration auxiliary (about 50% aqueous solution of a condensation product of aromatic sulfonic acids), 10.0 parts of a retanning agent (about 50% aqueous solution of a mixture of a vegetable tanning agent and a condensation product of aromatic sulfones which has a tanning action), 15.0 parts of a retanning agent (about 55% aqueous solution of a condensation product of phenolsulfonic acid and aromatic hydroxy sulfones), 47.5 parts of a fatliquoring agent (about 50% aqueous solution of a fatliquoring agent based on sulfited natural and synthetic fats), 2.5 parts of a stabilizer for the fatliquoring agent (sulfated fatty alcohol).

This mixture is spray-dried at atmospheric pressure and at 110° C. to give a powder which is suitable for the wet dressing of wet blue and of wet white, in particular for the preparation of furniture and car upholstery leathers and also shoe leathers.

EXAMPLE 2

The following components are mixed at room temperature to form a homogeneous mixture:

12.5 parts of a neutralizing agent (about 35% aqueous solution of a mixture of aromatic sulfonic acids with aliphatic dicarboxylic acids), 12.5 parts of a penetration auxiliary (about 50% aqueous solution of a condensation product of aromatic sulfonic acids), 10.0 parts of a retannning agent (about 30% aqueous solution of an acrylate copolymer), 15.0 parts of a retanning agent (about 55% aqueous solution of a condensation product of aromatic hydroxy sulfones and sulfonic acids), 47.5 parts of a fatliquoring agent (about 50% aqueous solution of a fatliquoring agent based on sulfited natural and synthetic fats) and 2.5 parts of stabilizer for the fatliquoring agent (sulfated fatty alcohol).

This mixture is spray-dried at atmospheric pressure and at 110° C. to give a powder which is suitable for the wet dressing of wet blue and of wet white, in particular for the preparation of furniture and car upholstery leathers and also shoe leathers.

EXAMPLE 3

The following components are mixed at room temperature to form a homogeneous mixture:

24.0 parts of a retanning agent (about 50% aqueous solution of a condensation product of sulfones and sulfonic acids of cyclic compounds), 20.0 parts of retannning agent (about 50% aqueous solution of a mixture of a vegetable tanning agent and a condensation product of aromatic sulfones which has a tanning action), 20.0 parts of a liquid melamine resin, 12.0 parts of a retanning agent (about 30% aqueous solution of an acrylate copolymer), and 24.0 parts of a fatliquoring agent (about 50% aqueous solution of a fatliquoring agent based on sulfited natural and synthetic fats).

This mixture is spray-dried at atmospheric pressure and at 110° C. to give a powder which is suitable for the wet dressing of wet blue and of wet white, in particular for the preparation of shoe upper leather.

EXAMPLE 4

A piece of wet blue (cattle) is placed in a vat in 180% of water at 30°, and 1.5% of sodium bicarbonate is added. After 10 minutes, 10% of the composition of Example 1 is added and the leather is treated at 30° for 60 minutes. Then 100% of water is added and the temperature is raised to 60°. Over the course of 10 minutes, 2% of formic acid in two portions is added and treatment is continued for 30 minutes. Then the liquor is drained, and the leather is rinsed for 5 minutes with 200% of cold water and finished conventionally.

The resulting leather is markedly softer than leather prepared in conventional manner, in whose preparation the neutralization, retanning and fatliquoring have each been carried out individually in succession. Moreover, it is distinguished by improved tear strength and lower fogging values at the same time as lower preparation costs.

EXAMPLE 5

The following components are mixed at room temperature to form a homogeneous mixture:

12.5 parts of a neutralizing agent (about 35% aqueous solution of a mixture of aromatic sulfonic acids with aliphatic dicarboxylic acids), 12.5 parts of a penetration auxiliary (about 50% aqueous solution of a condensation product of aromatic sulfonic acids), 10.0 parts of retannning agent (about 50% aqueous solution of a mixture of a vegetable tanning agent and a condensation product of aromatic sulfones which has a tanning action), 15.0 parts of a retanning agent (about 55% aqueous solution of a condensation product of phenolsulfonic acid and aromatic hydroxy sulfones), 47.5 parts of a fatliquoring agent (about 50% aqueous solution of a fatliquoring agent based on sulfited natural and synthetic fats), 2.5 parts of stabilizer for the fatliquoring agent (sulfated fatty alcohol), 32.0 parts of an aqueous dye formulation containing 40% by weight of the black dye C.I. Acid Black 210, and 4.0 parts of an aqueous dye formulation containing about 50% by weight of carbon black.

This mixture is spray-dried at atmospheric pressure and at 110° C.

If the procedure described in Example 4 is followed but 20% of the mixture described above is used instead of the composition of Example 1, then a level black dyeing of the leather is obtained which has markedly better dye penetration than a conventionally prepared leather in whose preparation the neutralization, retanning, fatliquoring and dyeing are in each case carried out individually in succession.

EXAMPLE 6

The following components are mixed at room temperature to form a homogeneous mixture:

3.5 parts of a vegetable tanning agent, 15.0 parts of a retanning agent (about 50% aqueous solution of a condensation product of aromatic sulfones which has a tanning action), 5.5 parts of a retanning agent (about 40% aqueous solution of an acrylate copolymer), 26.5 parts of a neutralizing agent (about 50% aqueous solution of a mixture of aromatic sulfonic acids with aliphatic dicarboxylic acids), 5.5 parts of a penetration auxiliary (about 40% aqueous solution of a condensation product of aromatic sulfonic acids), 30.5 parts of a fatliquoring agent (about 50% aqueous solution of a fatliquoring agent based on sulfited natural and synthetic fats), 13.0 parts of a carrier (Glauber salt).

This mixture is spray-dried at atmospheric pressure and at 110° C. to give a powder which is suitable for the wet dressing of wet blue and of wet white, in particular for the preparation of shoe upper leather.

EXAMPLE 7

A piece of wet blue (cattle), shaved to 1.9 mm, is placed in a vat in 30% of water at 30°, 15% of the composition of Example 6 is added and the leather is treated at 30° for 30 minutes. Then 3% of the black powder dye C.I. acid black 210 is added and treatment is carried out at 30° for 90 minutes.

Then 200% of water is added and the temperature is raised to 60°. Over the course of 10 minutes, 1% of formic acid is added and treatment is continued for 30 minutes. Then the liquor is drained, and the leather is rinsed for 5 minutes with 200% of cold water and finished conventionally.

The resulting leather is markedly softer than leather prepared in conventional manner, in whose preparation the neutralization, retanning and fatliquoring have each been carried out individually in succession.

What is claimed is:

1. A composition for the preparation of leather or pelts which is solid at a temperature below 40° C., which comprises a) 10–80% by weight of a retanning agent and b) 5–50% by weight of a fatliquoring agent and optionally c) 0–55% by weight of a neutralizing agent and d) additional optional components selected from the group consisting of carriers, colorants, impregnants, dressing agents and dressing auxiliaries, each based on the total weight of said composition, and is present in a form such that on addition of said composition to water at from 10 to 60° C. so that the ratio of water to the composition is at least 8:1, said composition forms a homogeneous mixture in the water.

2. A composition according to claim 1, which on addition to water forms micelles containing retanning agent and fatliquor agent.

3. A composition according to claim 1, which on incorporation by stirring into water gives a dispersion or suspension of particles in which 50% of the particles have a size below 15 $\mu$m.

4. A composition according to claim 1, which on incorporation by stirring into water gives a dispersion or suspension of particles in which 90% of the particles have a size below 40 $\mu$m.

5. A composition according to claim 1, which comprises an effective amount of a neutralizing agent to adjust the pH to a value of from 4.5 to below 7.

6. A composition according to claim 5, in which the neutralizing agent is selected from the group consisting of alkali metal salts of inorganic or organic weak acids, aromatic sulfonic acids and aliphatic mono- or dicarboxylic acids.

7. A composition according to claim 6, in which the neutralizing agent is selected from the group consisting of sodium or potassium bicarbonate, formate or acetate, oxalic acid, malonic acid, adipic acid and condensed sulfonated phenols.

8. A composition according to claim 7, in which the neutralizing agent is selected from the group consisting of sodium bicarbonate, sodium formate, acetic acid, adipic acid and sulfonated diphenyl sulfones.

9. A composition according to claim 1, which comprises, as retanning agent, a vegetable tanning agent, an aromatic syntan, a resin tanning agent, a reactive tanning agent or a mineral tanning agent or polymeric tanning agent.

10. A composition according to claim 9, which comprises, as retanning agent, a vegetable tanning agent, an aromatic syntan or a reactive tanning agent.

11. A composition according to claim 1, which comprises as fatliquoring agent a) a fatliquoring agent based on animal fats, b) a fatliquoring agent based on vegetable fats, c) a synthetic fatliquoring agent, or d) a mineral oil or a petrochemical product.

12. A composition according to claim 11, wherein the fatliquoring agent is in a form modified by sulfating, sulfiting or the formation of sulfonic acids so that the fatliquorinq agent is soluble or emulsifiable in water.

13. A composition according to claim 1, in which the carrier comprises sodium chloride, Glauber salt, sodium formate, protein powders or starch.

14. A composition according to claim 1, in which the additional component comprises a colorant.

15. A composition according to claim 14, in which the colorant comprises a natural dye, a synthetic anionic or metal complex, a direct or sulfur dye or a pigment.

16. A composition according to claim 1, comprising a) 10–60% by weight of a retanning agent, b) 10–45% by weight of a fatliquoring agent, c) 10–40% by weight of a neutralizing agent, and d) 0–40% by weight of additional components selected from the grout consisting of carriers, colorants, impregnants, dressing agents and dressing auxiliaries, each based on the total weight of said composition.

17. A composition according to claim 16, comprising a) 20–60% by weight of a retanning agent, b) 10–40% by weight of a fatliquoring agent, c) 10–25% by weight of a neutralizing agent, and d) 2–35% by weight of additional components selected from the group consisting of carriers, colorants, impregnants, dressing agents and dressing auxiliaries, each based on the total weight of said composition.

18. A process for preparing a composition which is solid at a temperature below 40° C. as defined in claim 1, which comprises mixing the retanning agent, the fatliquoring agent and any optional neutralizing agent and additional components with one another in undiluted form.

19. A process for preparing a composition as defined in claim 1, which comprises mixing the retanning agent, the fatliquoring agent and any optional neutralizing agent and additional components, in the form of solutions, suspensions or dispersions, with each other, and then drying the resulting mixture to obtain a composition which is in solid form at a temperature below 40° C.

20. A process according to claim 19, wherein, after mixing, the solution, suspension or dispersion is subjected to ultrasonic treatment.

21. A process according to claim 19, wherein drying is carried out by spray drying.

22. A process according to claim 19, wherein the drying is carried out such that the solution, suspension or dispersion is dried without separating.

* * * * *